US006217678B1

(12) United States Patent
Momozaki et al.

(10) Patent No.: US 6,217,678 B1
(45) Date of Patent: Apr. 17, 2001

(54) STEEL WIRE ROD OR BAR WITH GOOD COLD DEFORMABILITY AND MACHINE PARTS MADE THEREOF

(75) Inventors: Kan Momozaki; Hideo Hata; Toyofumi Hasegawa, all of Kobe (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 09/295,354

(22) Filed: Apr. 21, 1999

(30) Foreign Application Priority Data

Apr. 21, 1998 (JP) ..... 10-111130

(51) Int. Cl.[7] ..... C21D 8/06

(52) U.S. Cl. ..... 148/598; 148/654; 148/320; 148/333; 420/104; 420/128

(58) Field of Search ..... 148/318, 319, 148/320, 333, 598, 654; 420/104, 128

(56) References Cited

U.S. PATENT DOCUMENTS 5,746,843 * 5/1998 Miyata et al. ..... 148/333
5,817,196 * 10/1998 Teracher et al. ..... 148/320

FOREIGN PATENT DOCUMENTS 0 643 142 3/1995 (EP) .
55-73827 6/1980 (JP) .
56-005951 * 1/1981 (JP) .
60-152624 8/1985 (JP) .
62-227031 10/1987 (JP) .

OTHER PUBLICATIONS

Patent Abstracts of Japan, vol. 006, No. 044 (C–095), Mar. 19, 1982, JP 56 158841, Dec. 7, 1981.

F. G. Wilson, et al., International Materials Reviews, vol. 33, No. 5, pp. 221, 237–249, "Aluminum Nitride in Steel," 1988.

Patent Abstracts of Japan, vol. 008, No. 110 (C–224), May 23, 1984, JP 59–025933, Feb. 10, 1984.

Patent Abstracts of Japan, vol. 006, No. 149 (C–118), Aug. 10, 1982, JP 57–070233, Apr. 30, 1982.

* cited by examiner

*Primary Examiner*—George Wyszomierski
(74) *Attorney, Agent, or Firm*—Oblon, Spivak, McClelland, Maier & Neustadt, P.C.

(57) ABSTRACT

The present invention provides a steel wire rod or bar which exhibits good cold deformability even though it does not undergo spheroidizing annealing after hot rolling. The steel wire rod or bar with good cold deformability is characterized in that its ferrite structure contains no less than 25 nitride and carbide particles in a mixed state or composite state per 25 μm on average in a sectional area three-fourths of the diameter within the circumference of the rod or bar. Such nitride and carbide precipitates contribute to the reduction of flow stress at temperatures raised by heat generation at the time of cold deforming.

16 Claims, 6 Drawing Sheets

STEEL WIRE ROD OR BAR WITH GOOD COLD DEFORMABILITY AND MACHINE PARTS MADE THEREOF

BACKGROUND OF THE INVENTION

1. Field of the Invention

The present invention relates to a steel wire rod or bar (hereafter occasionally abbreviated to steel) having good cold deformability and to machine parts made therefrom. More particularly, the present invention relates to a steel wire rod or bar having excellent cold deformability without the need for heat treatment to soften after hot rolling. The present invention is especially suitable for making machine parts, such as bolts and nuts, by cold deforming processes, such as cold forging, cold heading, and cold roll forging.

2. Description of the Related Art

Cold deforming is widely used to produce bolts and nuts and other machine parts. Because of its higher productivity and hence higher yields, cold deforming is more efficient than hot deforming and machining. The steel wire rod or bar used for cold deforming should have low flow stress and high workability. High flow stress will reduce the life of tools used for cold deforming; low workability will be subject to cracking during cold deforming, which leads to defective products.

It has been common practice to carry out various heat treatments to soften steel wire rods and bars, such as spheroidizing annealing and annealing prior to cold deforming in order to lower the flow stress and increase the workability of the steel. The annealing step makes the steel wire rod or bar soft and workable enough for cold deforming. Unfortunately, spheroidizing annealing takes a long time (10–20 hours), and, from the standpoint of productivity improvement, energy saving, and cost reduction, there has been an earnest demand for the development of a steel wire rod or bar which exhibits good cold deformability without requiring spheroidizing annealing.

There have been proposed several methods of producing a steel wire rod or bar which exhibits good cold deformability without heat treatment to soften. In these methods, attention is paid to solute C and solute N as in the case of the present invention. They are exemplified below.

(1) Japanese Patent Publication No. 35249/1986 discloses a method of suppressing work hardening due to strain aging, thereby reducing flow stress, as the result of controlling the rolling and cooling conditions, thereby reducing the content of solute C and solute N.

(2) Japanese Patent Laid-open No. 158841/1981 discloses a method of producing a hot-rolled wire rod that is suitable for long die life by employing Ti or B as an element to form nitrides.

(3) Japanese Patent Laid-open No. 39002/1992 discloses a method of producing a hot-rolled wire rod that is suitable for long die life by controlling the Al/N ratio. These two methods are based on the finding that hardness and work hardening are reduced if solute N is fixed.

(4) Japanese Patent Laid-open No. 63635/1982 discloses a method of producing a steel wire rod f or cold forging, which permits an extended tool life, by keeping the steel for 5 hours or more at a temperature between the $A_{cl}$ transformation point and the $A_{cl}$ transformation point minus 50° C., thereby solidifying cementite sufficiently and fixing solute N through the controlled Al content.

The above-mentioned four methods are designed to fix solute C and solute N which adversely affect the reduction of flow stress. However, the objects of the above-mentioned references are achieved by controlling the chemical composition of the steel or controlling the rolling and cooling conditions. Nothing is found in the above-mentioned disclosures about the present inventors' discovery that when more than a prescribed number of nitride and carbide particles precipitate in the ferrite particles, the content of solute N and solute C is very effectively reduced and the flow stress is suppressed not only in the initial stage of cold deforming but also in the working stage where the temperature is nearly 100 to 350° C. In fact, the disclosures (2) to (4) above mention nothing about the reduction of flow stress in the later stage of working. No one has ever studied the relation between the flow stress and the number of nitride and carbide particles in the ferrite structure, and the present inventors are the first to study it.

SUMMARY OF THE INVENTION

Accordingly, one object of the present invention is to provide a steel wire rod or bar which exhibits good cold deformability during cold deforming without the need for spheroidizing aitealing after hot rolling.

Another object of the present invention is to provide machine parts, such as bolts and nuts, made from the steel wire rod or bar.

To solve the above-mentioned problems, the first embodiment of the present invention provides a steel wire rod or bar with good cold deformability which is characterized in that its ferrite structure contains no less than 25 nitride and carbide particles in a mixed state or composite state per 25 $\mu m^2$ on average in a cross-sectional area corresponding to a concentric circle having a radius three-fourths the radius of the rod or bar.

Another embodiment of the invention relates to a steel wire rod or bar, including:

a ferrite structure;

wherein the ferrite structure includes nitride-nucleated carbide particles, and wherein the particles are present in an amount of no less than 25 particles per 25 $\mu m^2$ on average in a sectional area corresponding to a concentric circle having a radius that is three-fourths of the radius of the rod or bar.

Another embodiment of the invention relates to a machine part made from the steel wire rod or bar.

Another embodiment of the invention relates to a process for preparing the steel wire rod or bar of the present invention that includes the steps of heating a billet at 850–1050° C., rolling it at 725–1000° C. until a desired diameter is reached, cooling with running water at a cooling rate of 600–6000° C./min down to 725–950° C., and continuing cooling at a cooling rate of 3–600° C./min down to 400° C.

DESCRIPTION OF THE PREFERRED EMBODIMENTS

Figure 1:
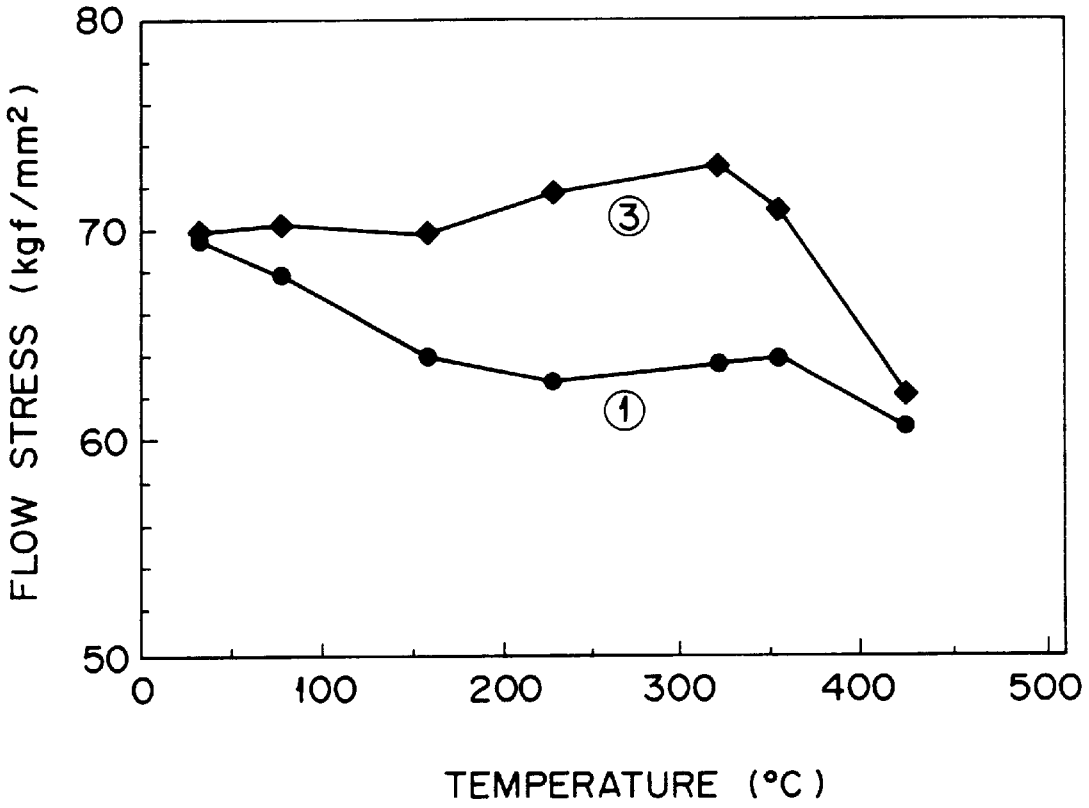
FIG. 1 is a graph showing the relation between the temperature and the flow stress.

Various other objects, features and attendant advantages of the present invention will be more fully appreciated as the same becomes better understood from the following detailed description when considered in connection with the accompanying figures in which like reference characters designate like or corresponding parts throughout the several views and which is not intended to be limiting unless otherwise specified.

Preferably, the ferrite structure contains no less than 25 nitride-nucleated carbide particles per 25 $\mu m^2$ on average. Such nitrides and carbides effectively lower the flow stress encountered in cold deforming at temperatures between about 100 to 350° C. due to heat generation by working.

Preferably, the steel wire rod or bar of the invention contains:

C: 0.001–0.5 mass %,

Al: no more than 0.1 mass % (excluding 0 mass %), and

N: no more than 0.015 mass % (excluding 0 mass %).

The steel wire rod or bar should preferably contain, in addition to the above-mentioned components, at least one element of:

Cr: no more than 1.2 mass % (excluding 0 mass %),

Ti: no more than 0.2 mass % (excluding 0 mass %),

B: no more than 0.01 mass % (excluding 0 mass %),

Nb: no more than 0.15 mass % (excluding 0 mass %),

V: no more than 0.2 mass % (excluding 0 mass %),

Zr: no more than 0.1 mass % (excluding 0 mass %), and/or

Mn: 0.035–2 mass %,

Si: no more than 0.5 mass % (excluding 0 mass %),

S: no more than 0.02 mass % (excluding 0 mass %).

Preferably, the steel wire rod or bar may additionally contain minor components and unavoidable impurities. The steel wire rod or bar of the present invention is especially suited for making machine parts. Non limiting examples of machine parts include nuts, bolts, screws, washers, pins, fasteners, bushings, brackets, springs, chain and gears. Other machine parts are also within the skill of the ordinary artisan given the teachings herein.

In order to provide a steel wire rod or bar which exhibits good cold deformability in its cold-rolled form, the present inventors carefully studied the solute N and solute C which govern the cold deformability, particularly the flow stress. The inventors discovered that (i) solute N and solute C can be changed into fixed nitrogen and fixed carbon if the ferrite-pearlite structure, particularly the ferrite structure, constituting the internal structure of the steel wire rod or bar has more than a prescribed number of precipitated fine nitride particles and additionally more than a prescribed number of nitride-nucleated fine carbide particles, such as cementite. This is believed to suppress the dynamic strain aging and hence decrease the flow stress, even though the initial strength is the same. The inventors have also discovered that (ii) the resulting structure lowers the flow stress not only in the initial stage of cold deforming but also in the working stage where the temperature is in the range of 100 to 350° C.

According to the present invention, the steel wire rod or bar is preferably characterized in that its ferrite structure contains nitride and carbide particles in a mixed state or composite state counting no less than 25 per 25 $\mu m^2$ on average in its sectional area one-eight of its diameter within its circumference. The nitride and carbide particles, more than a prescribed number of which precipitate in the ferrite structure, fix solute N and solute C, which adversely affect the flow stress and hence reduce the flow stress not only in the initial stage or working but also in the later stage of working (at about 100–350° C.).

The nitride denotes any nitride of one or more of Al, Cr, Ti, B, Nb, V, and Zr and mixtures thereof which has precipitated by combination with solute N.

The carbide includes iron carbide, such as cementite ($Fe_3C$), and any carbide of one or more of Cr, Ti, Nb, V, B and Zr and mixtures thereof by combination with C in the steel. The iron carbide and the carbide may contain any other element in Groups IA–VIIIA and IB–VIIB of the Periodic Table, but most preferably Mn, P, S, etc.

Figure 4:
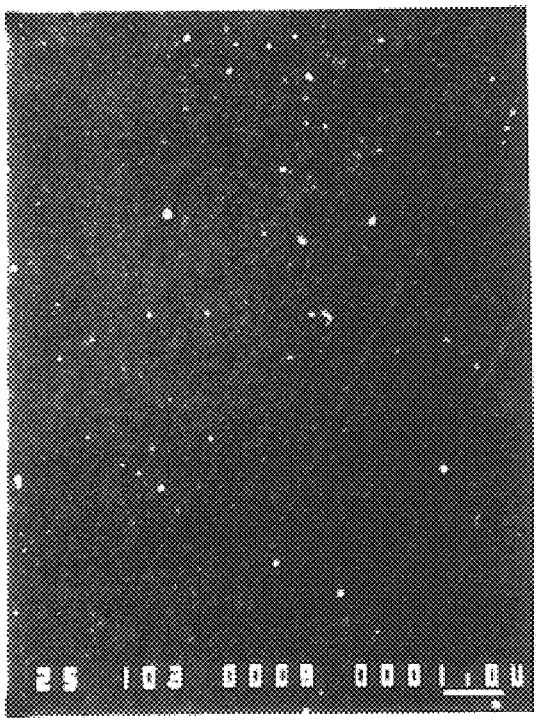
FIG. 4 is an electron micrograph showing how precipitates occur in the ferrite structure (in the comparative example)

Preferably, the steel wire rod or bar of the present invention contains these nitride and carbide particles in a mixed or composite state. For example, the carbide may precipitate by nucleation by the nitride. The state of the precipitate may be understood by reference to FIG. 4 attached hereto. "Nitride and carbide" or "precipitate" which will appear in the following denotes the nitride and carbide which are present in the above-mentioned state.

Now, a most preferred example establishing the number of precipitated nitride and carbide particles is described with reference to FIG. 1, which is not intended to be limiting unless otherwise specified.

FIG. 1 graphically shows how the flow stress varies according as the test pieces Nos. 1 and 3 (described in Example given later) are heated to 78° C., 150° C., 220° C., 330° C., 350° C., and 424° C. In FIG. 1, solid circles (●) represent the test piece (No. 1) which contains 78 particles of nitride and carbide as prescribed in the present invention, and solid diamond (◆) represent the test piece (No. 3) which contains only 21 particles of nitride and carbide, not conforming to the present invention.

It is noted from FIG. 1 that the specimen No. 3 (which does not meet the requirements of the present invention) increases in flow stress with increasing temperature, reaching the maximum at about 300° C. This is attributable to the remarkable dynamic strain aging due to solute C and solute N. By contrast, the specimen No. 1 (which meets the requirements of the present invention) does not increase in flow stress even at an increased temperature of about 300 ° C. due to working because as many nitride and carbide particles as prescribed are formed in the ferrite so that the dynamic strain aging is suppressed.

What follows is a possible reason why the flow stress at about 300° C. is suppressed when as many nitride and carbide particles as prescribed are formed in the ferrite structure. In general, an increase in the amount of solute N and solute C in ferrite amplifies work hardening due to strain aging and hence heighten flow stress. In the present invention, this is most preferably avoided by causing solute N (which adversely affects flow stress) to combine with Al or any other element (which forms nitrides). The resulting nitrides precipitate in the form of fine particles in an amount according to the present invention, and these nitride particles function as the nuclei which cause the carbide (such as cementite) to precipitate in the form of fine particles in an amount according to the present invention.

For the nitride and carbide particles to produce the effect of reducing flow stress, it is preferred that the ferrite structure in the steel wire rod or bar contain no less than 25 nitride and/or carbide particles in a mixed state or composite state per 25 $\mu m^2$ on average in a cross-sectional area one-eighth of its diameter within its circumference. This number is closely related with the average diameter of the nitride and carbide particles. That is, the number of precipitated particles decreases as the cooling rate decreases and hence these precipitated particles increase in average diameter. Most preferably, the number of nitride and carbide particles should be established in relation to the average diameter. Usually, if the nitride particles have an average diameter of 1–10 nm and the carbide particles have an average diameter of 10–50 nm, their number on average should be no less than 35/25 $\mu m^2$, preferably no less than 40/25 $\mu m^2$ more preferably no less than 45/25 $\mu m^2$, on the assumption that the nitride and carbide particles are present in a mixed or composite state. If the nitride particles have an average diameter of 10–50 nm and the carbide particles have an average diameter of 50–500 nm, the number of precipitated particles should be no less than 25/25 $\mu m^2$, preferably no less than 30/25 $\mu m^2$, more preferably no less than 35/25 $\mu m^2$, on average.

The steel wire rod or bar of the present invention, which has undergone hot rolling, is composed mainly of the structure having the above-mentioned nitride and carbide. To be more specific, the metal structure should preferably be one in which ferrite accounts for no less than 20% (preferably no less than 25% and more preferably no less than 35%) in terms of area. This requirement is the condition that the above-mentioned precipitates effectively function so as to keep flow stress low for the same ferrite fraction.

The most preferred point of the present invention consists in that the ferrite structure contains as many nitride and carbide particles as prescribed. Therefore, the steel wire rod or bar should preferably be positively incorporated with C, N, and Al, and other minor elements so that the desired nitride and carbide are formed. The following describes the most preferred chemical composition of the steel wire rod or bar of the present invention.

C: 0.001–0.5 Mass %

C is a preferred element that imparts strength to the steel wire rod or bar. With an amount less than 0.001 mass %, C does not provide the desired strength. In addition, it is industrially and economically disadvantageous to keep the C content at such a low level. The C content should preferably be no less than 0.003 mass %, more preferably no less than 0.005 mass % and more particularly preferably no less than 0.01 mass %. Conversely, C in excess of 0.5 mass % lowers the ferrite fraction, which prevents the desired effect. The C content should preferably be no more than 0.48 mass % and more preferably no more than 0.4 mass %.

Al: No More Than 0.1 Mass % (Excluding 0 Mass %)

Al is useful for deoxidation. It is added to fix solute N, thereby forming nitride (AlN). To achieve this object, it should preferably be added in an amount no less than 0.005%. However, Al added in excess of 0.1 mass % will be wasted because its effect levels off. A more preferable amount is no more than 0.08 mass %. A most preferable amount is no more than 0.09 mass %.

N: No More Than 0.015 Mass % (Excluding 0 Mass %)

Usually, N is an unnecessary element in view of the fact that solute N adversely affects the reduction of flow stress. However, in the present invention, N in a certain amount is preferable so that N forms nitrides (such as AlN) which nucleate carbides (such as cementite) to be precipitated. A preferable amount is no less than 0.001 mass %, more preferably no less than 0.005 mass %. On the other hand, N in excess of 0.015 mass % makes it necessary to increase the amount of alloy element to be added for the nitride to precipitate as much as prescribed. This leads to a cost increase. A preferable amount is no more than 0.01 mass %, more preferably no more than 0.008 mass %.

The steel wire rod or bar of the present invention most preferably contains the above-mentioned components, with the remainder being iron and unavoidable impurities. Most particularly preferably, it may be positively incorporated with the following additional elements.

At least one species selected from the group consisting of Cr (no more than 1. 2 mass %), Ti (no more than 0.2 mass %), B (no more than 0.01 mass %), Nb (no more than 0.15 mass %), V (no more than 0.2 mass %), and Zr (no more than 0.1 mass %) and mixtures thereof (each excluding 0 mass %).

These elements (Cr, Ti, Nb, V, and Zr) form carbides and/or nitrides, and B forms nitrides like Al. They reduce solute C and solute N which adversely affect the flow stress. It is most preferably recommended to add Cr (no less than 0.02 mass %), Ti (no less than 0.01 mass %), B (no less than 0.0003 mass %), Nb (no less than 0.005 mass %), V (no less than 0.01 mass %), and Zr (no less than 0.005 mass %). Their effect will level off if they are added in an amount more than specified. Their most preferable amounts are as follows. Cr: no more than 0.1 mass %, Ti no more than 0.15 mass %, B : no more than 0.008 mass %, Nb: no more than 0.1 mass %, V: no more than 0.15 mass %, and Zr : no more than 0.08 mass %. These elements may be used alone or in combination with one another.

Additional preferred elements that can be incorporated are shown below.

Mn: 0.035–2 Mass %

Mn less than 0.035 mass % is not enough to completely convert S into MnS; and this leads to poor workability. An amount more than 0.05 mass % is preferable. More preferably, the amount is more than 0.07 mass %. On the other hand, Mn in excess of 2 mass % will increase the rolling load and hence decrease the tool life. An amount less than 1.8 mass % is preferable. More preferably, the amount is less than 1.5 mass %.

Si: No More Than 0.5 Mass % (Excluding 0 Mass %)

Si as a deoxidizer should preferably be added in an amount no less than 0.005 mass %, more preferably no less than 0.008 mass %, and most preferably no less than 0.01 mass % so that it produces its effect. Si added in excess of 0.5 mass % will produce no additional effect but merely increase the flow stress. A preferable amount is no less than 0.45 mass %, and more preferably less than 0.35 mass %.

S: No More Than 0.02 Mass % (Excluding 0 Mass %)

When added in more than 0.02 mass %, S tends to cause cracking during cold deforming. A preferable amount is no more than 0.018 mass %, more preferably no more than 0.01 mass %.

The steel wire rod or bar of the present invention is preferably produced according to the description below.

The steel wire rod or bar of the present invention is preferably produced by the steps of heating a billet at 850–1050° C., rolling it at 725–1000° C. until a desired diameter is reached, cooling with running water at a cooling rate of 600–6000° C./min down to 725–950° C., and continuing cooling at a cooling rate of 3–600° C./min down to 400° C. These steps are most preferable as explained below so as to obtain as many nitride and carbide particles as prescribed in the present invention.

Billet Heating Temperature: 850–1050° C.

This heating temperature is a prerequisite condition that nitrides (such as AlN) partly form a solid solution and precipitate as fine particles after rolling. When heated above 1050° C., precipitated nitrides completely become a solid solution, thereby forming solute N. In this state, nitrides cannot be precipitated no matter what the subsequent control. The heating temperature should preferably be no higher than 1025° C., more preferably no higher than 1000° C., and most preferably no higher than 975° C. By contrast, at a heating temperature lower than 850° C., nitrides (such as AlN) do not form a solid solution at all and hence they do not nucleate carbides. The heating temperature should preferably be no lower than 870° C., more preferably no lower than 890° C., most preferably no lower than 900° C.

Average Rolling Temperature 725–1000° C.

This rolling temperature is a prerequisite condition that nitrides form no solid solution during rolling as in the case of billet heating and dislocation occur in the steel structure. Dislocation permits the solute N to reprecipitate as fine nitride particles in the ferrite, which leads to the precipitation of carbides such as cementite. A practical rolling temperature is 750–1000° C. preferably no lower than 775° C., more preferably no lower than 765° C. and preferably no higher than 975° C., so that the load of rolling rolls will not increase, the dimensional accuracy will not decrease, and the surface defects will not occur.

Reeling Temperature: 725–950° C.

The rolling step is completed by cooling with water at a cooling rate of 600–6000° C./min, preferably 700–5000° C./min down to 725–950° C. At a temperature higher than 950° C., nitrides do not readily precipitate and hence solute C and dissolve N do not decrease as desired. A practical reeling temperature should preferably be no higher than 900° C., and more preferably no higher than 850° C. Conversely, at a temperature lower than 725° C., martensite occurs in the surface layer, resulting in a hard, brittle steel which is not suitable for cold deforming. A practical reeling temperature should preferably be no lower than 750° C., and more preferably no lower than 800° C.

Average Cooling Rate: 3–600° C./min (Down to 400° C.)

For solute C and solute N to precipitate as carbides and nitrides, it is desirable to keep the cooling rate low. An excessively slow cooling rate causes the lamellar space in pearlite (the lamellar structure of ferrite and cementite) to expand, with the resulting structure being poor in workability. A practical cooling rate should preferably be no lower than 6° C./min and more preferably no lower than 12° C./min and no higher than 500° C./min and more preferably no higher than 250° C./min.

After hot rolling as specified above, the steel wire rod or bar of the present invention has good cold deformability; however, with improved cold deformability, it may undergo more preferable additional steps such as descaling with acid (e.g., hydrochloric acid and sulfuric acid) or mechanical straining and subsequent coating with zinc phosphate, calcium phosphate, lime, zinc stearate and sodium stearate, etc. as a lubricant.

The diameter of the wire rod or bar is not particularly limited. Preferably, it is between 0.5–100 mm, more preferably between 1–75 mm, more particularly preferably 2–50 mm, more especially preferably 3–25 mm may include diameters of 5, 8, 9, 14, 15, 18 and 20 mm.

EXAMPLES

The invention will be described in more detail with reference to the following examples. It is to be understood that the examples may be modified variously without departing from the object of the invention and that the examples are not to be construed to limit the scope of the invention.

Various kinds of steels having the composition (mass %) as shown in Table 1 were prepared. They were rolled into wire rod (12 mm in diameter) under the conditions shown in Table 2. The resulting wire samples were tested for the following items. Average number of nitride and carbide particles precipitating in the wire rod.

Figure 2:
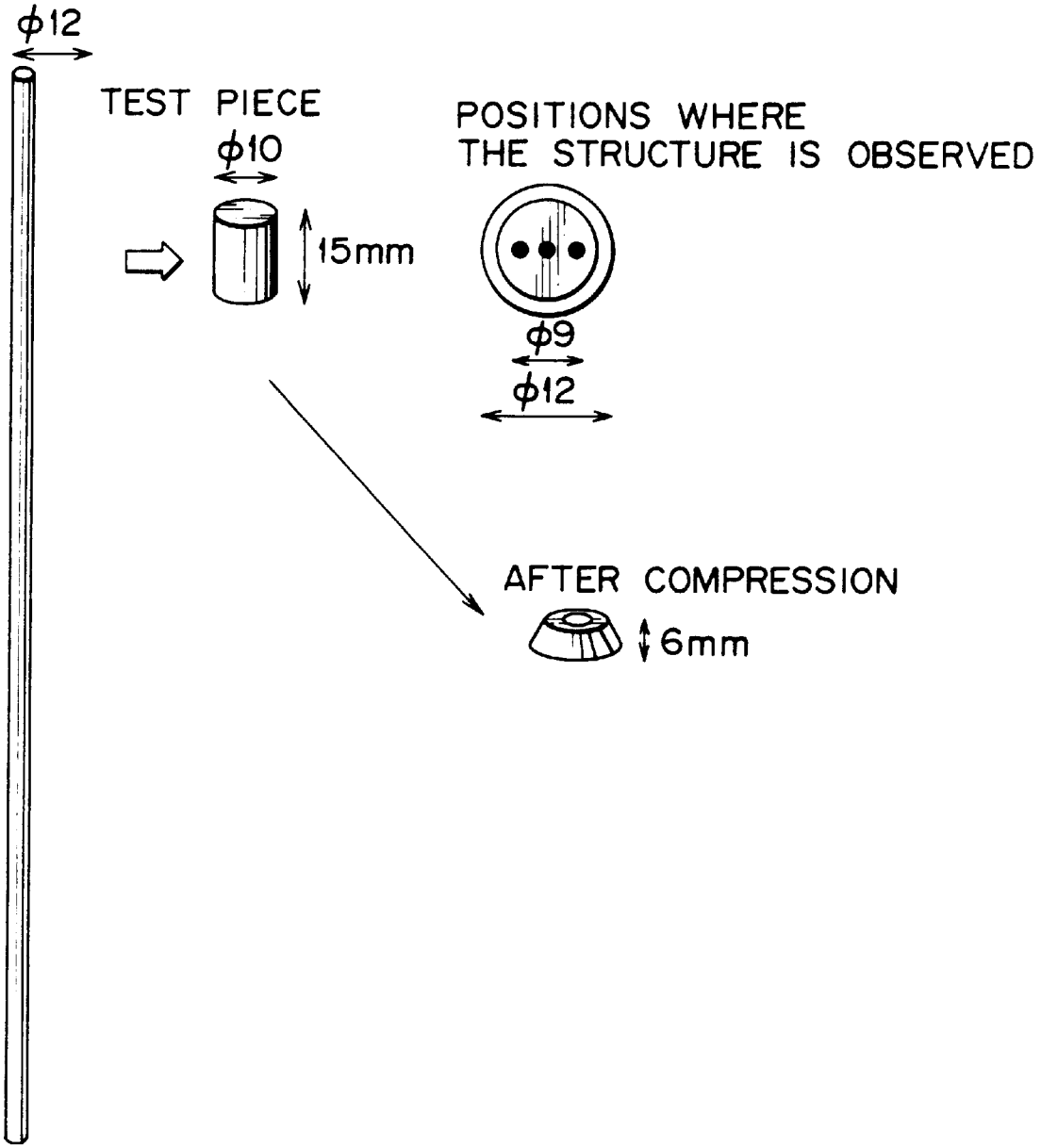
FIG. 2 is a schematic diagram showing the method of counting the number of precipitates.
Figure 3:
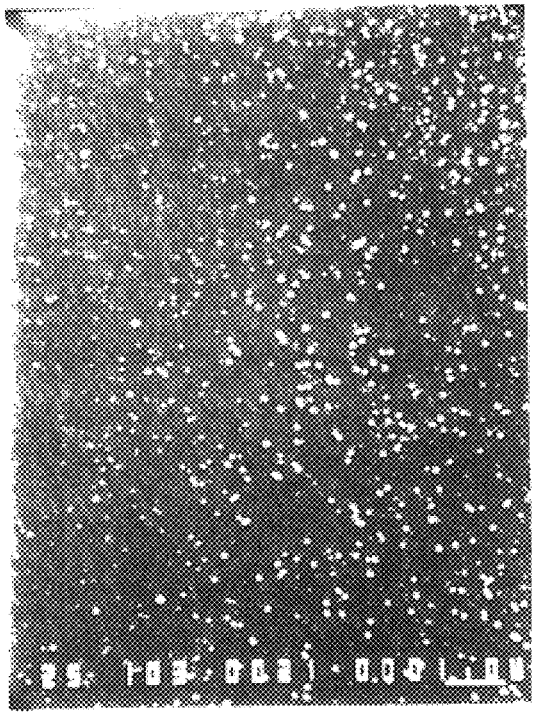
FIG. 3 is an electron micrograph showing how precipitates occur in the ferrite structure (in the example)

The number of precipitated particles in the ferrite structure was counted at three points in its sectional area corresponding to a concentric circle with three-fourths the radius thereof as shown in FIG. 2. These five points were selected to avoid the effect of decarburization due to hot rolling. Counting was carried out by photographing the precipitates using a scanning electron microscope (SEM, X8000) and processing the electron micrograph by image analysis (FRM tool kit). An average of five measurements was calculated. The specimen No. 1 (pertaining to the present invention) and the specimen No. 3 (for comparison), which are specified in Table 2, gave the electron micrographs (FIGS. 3 and 4) which show the precipitates in the ferrite structure.

Composition of Precipitates

Figure 5:
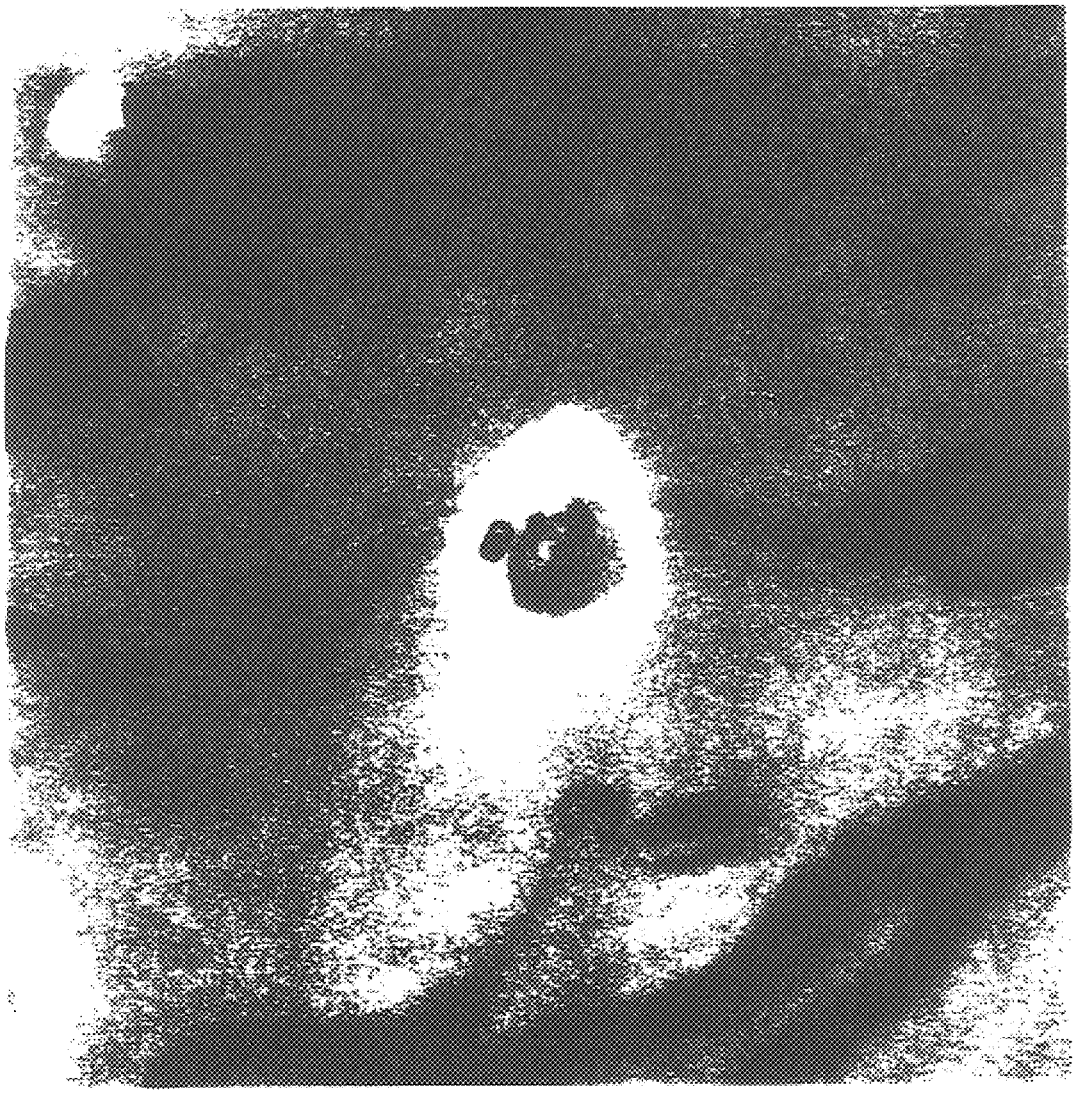
FIG. 5 is an electron micrograph showing the precipitates in the example.
Figure 6:
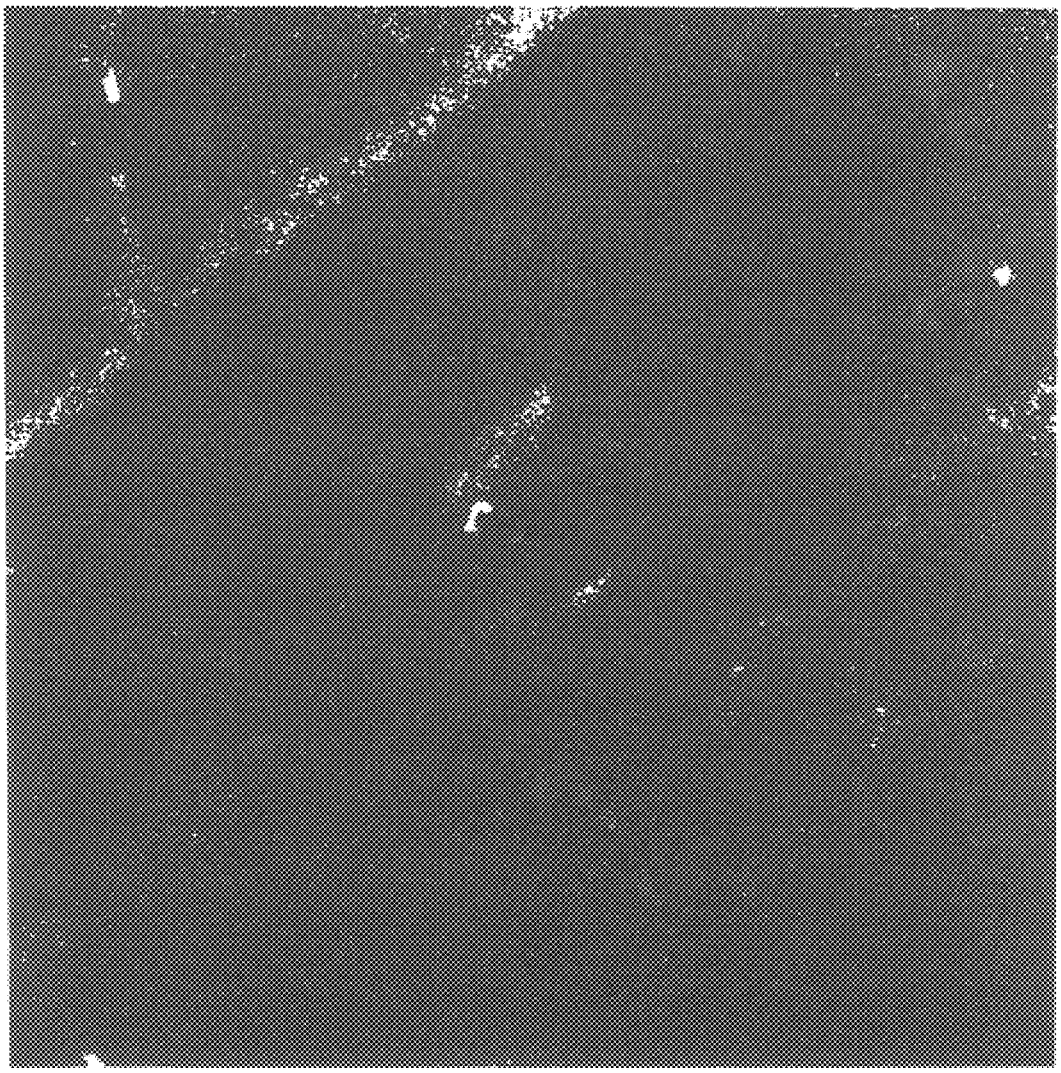
FIG. 6 is an electron micrograph showing the image of the nitrogen composition in FIG. 5.
Figure 7:
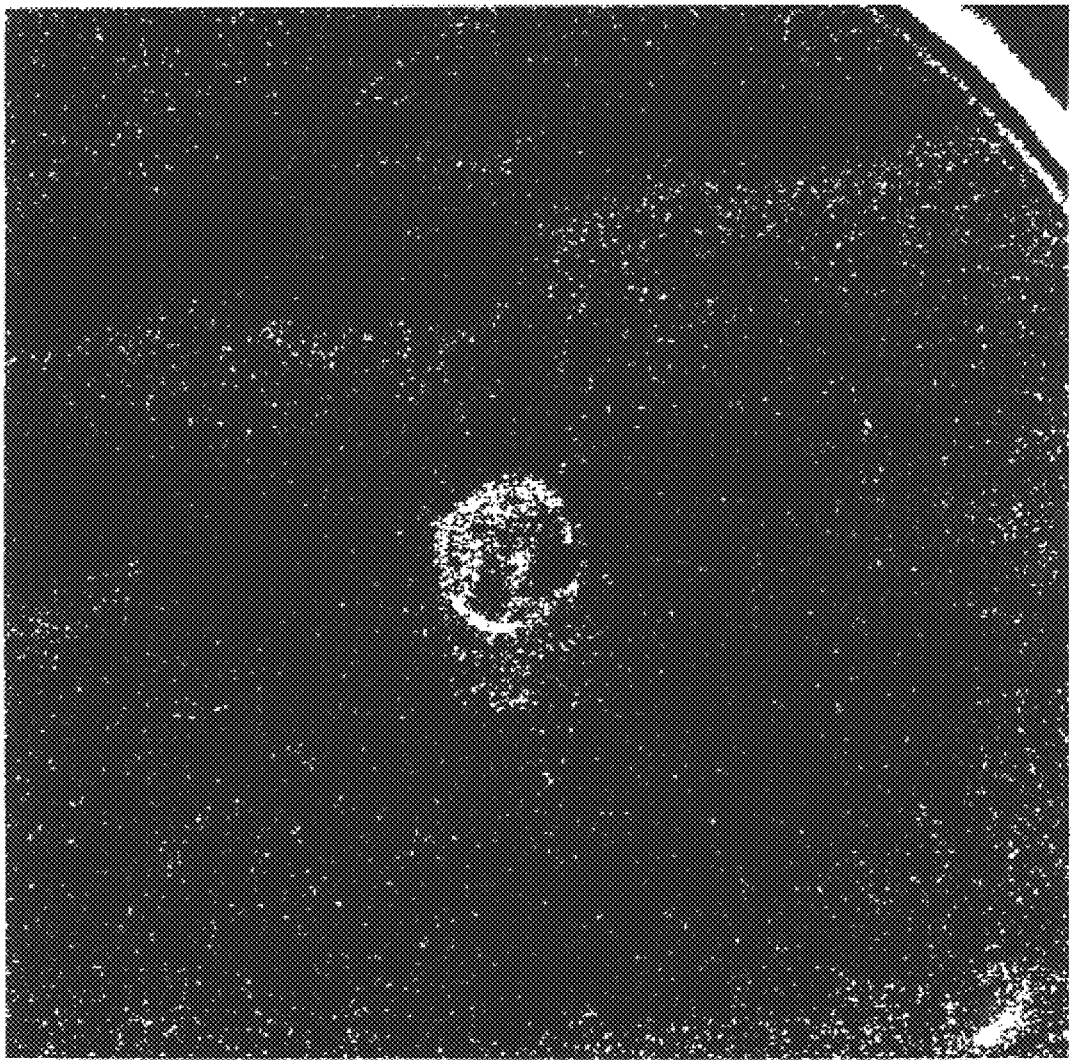
FIG. 7 is an electron micrograph showing the image of the carbon composition in FIG. 5.

To see if the precipitates are AlN-nucleated cementite, the specimen was examined by a transmission electron microscope (FE-TEM,×1,000,000) and analyzed by EELS (energy loss spectroscopy). The results were visualized by the aid of GIF (imaging filter made by GATAN Co., Ltd.), and the composition was analyzed. The specimen No. 2 (pertaining to the present invention), which is specified in Table 2, gave the electron micrographs (FIGS. 5 to 7) which show the results of the analysis of the precipitates. FIG. 5 is an electron micrograph which indicates that the precipitate is AlN-nucleated cementite; FIG. 6 is an electron micrograph showing the nitrogen composition; and FIG. 7 is an electron micrograph showing the carbon composition.

Measurement of Flow Stress

Flow stress is an index of cold deformability. It was measured by upsetting with a press in the following manner. A cylindrical specimen for upsetting was prepared from the wire by cutting to a size 15 long and 10 mm in diameter (upset ratio: 15/10=1.5) according to the recommendation by the Japan Plastic Working Institute (see "Tanzou, Soseikakou Gijutu Shiriizu 4", p. 55, issued by Corona Co., Ltd. the entire contents of which are hereby incorporated by reference).

The upsetting cylindrical test consists of compressing the specimen by 60%, and the maximum load required for compression is measured. The flow stress is calculated from the load as follows.

$$\text{Flow stress (kgf/mm}^2\text{)}=\text{load (kgf)}/A/f$$

where

A: sectional area of specimen ($mm^2$)

f: stress modification factor $$\text{Compression (\%)}=H_0H$$

where $H_0$: Height before compression,

H: Height after compression.

In the above formula, A is 78.5 $mm^2$ for a diameter of 10 mm, and f is 2.77 for 60% compression.

Incidentally, the flow stress was measured at normal temperature (25° C.) as well as at elevated temperatures (78° C., 150° C., 220° C., 320° C., 350° C., and 424° C.) in anticipation of a temperature rise (up to several hundreds of degrees) due to multistage cold deforming at a strain rate of $10^0$–$10^1$/sec in actual operation. To investigate the effect of dynamic strain aging on flow stress, an increase (kgf/mm$^2$) in flow stress due to dynamic strain aging was calculated according to the following formula. Increase in flow stress= [Flow stress ((σ320)at 320° C.]–[Flow stress ((σ25) at normal temperature (25° C.)]

The results of measurements and calculations are shown in Table 2.

TABLE 1

| Steel | C | Si | Mn | S | A1 | N | Cr | Ti | B | Nb | V | Zr |
|---|---|---|---|---|---|---|---|---|---|---|---|---|
| A1 | 0.20 | 0.02 | 0.44 | 0.006 | 0.045 | 0.0035 | tr | tr | tr | tr | tr | tr |
| A2 | 0.005 | 0.03 | 0.45 | 0.008 | 0.042 | 0.003 | tr | tr | tr | tr | tr | tr |
| A3 | 0.35 | 0.02 | 0.42 | 0.003 | 0.043 | 0.008 | tr | tr | tr | tr | tr | tr |
| A4 | 0.5 | 0.01 | 0.41 | 0.010 | 0.040 | 0.0042 | tr | tr | tr | tr | tr | tr |
| A5 | 0.21 | 0.4 | 0.43 | 0.011 | 0.039 | 0.008 | tr | tr | tr | tr | tr | tr |
| A6 | 0.23 | 0.015 | 0.05 | 0.008 | 0.041 | 0.005 | tr | tr | tr | tr | tr | tr |
| A7 | 0.15 | 0.02 | 2.00 | 0.012 | 0.042 | 0.006 | tr | tr | tr | tr | tr | tr |
| A8 | 0.19 | 0.01 | 0.45 | 0.02 | 0.044 | 0.005 | tr | tr | tr | tr | tr | tr |
| A9 | 0.22 | 0.03 | 0.42 | 0.010 | 0.100 | 0.004 | tr | tr | tr | tr | tr | tr |
| A10 | 0.20 | 0.05 | 0.41 | 0.003 | 0.045 | 0.0015 | tr | tr | tr | tr | tr | tr |
| A11 | 0.21 | 0.02 | 0.40 | 0.011 | 0.042 | 0.016 | tr | tr | tr | tr | tr | tr |
| A12 | 0.22 | 0.03 | 0.35 | 0.010 | 0.045 | 0.0045 | 0.95 | tr | tr | tr | tr | tr |
| A13 | 0.23 | 0.01 | 0.30 | 0.009 | 0.041 | 0.0041 | tr | 0.2 | tr | tr | tr | tr |
| A14 | 0.21 | 0.01 | 0.32 | 0.007 | 0.039 | 0.0033 | tr | tr | 0.005 | tr | tr | tr |
| A15 | 0.19 | 0.02 | 0.33 | 0.008 | 0.043 | 0.006 | tr | tr | tr | 0.09 | tr | tr |
| A16 | 0.22 | 0.02 | 0.35 | 0.011 | 0.042 | 0.005 | tr | tr | tr | tr | 0.18 | tr |
| A17 | 0.20 | 0.04 | 0.46 | 0.018 | 0.040 | 0.0035 | tr | tr | tr | tr | tr | 0.08 |

TABLE 2

| No. | Steel | Heating Temperature (° C.) | Average rolling temperature (° C.) | Average cooling rate (° C./min) | Average number of nitride and carbide particles in ferrite (/25 μm$^2$) | Average diameter of carbide particle (nm) | Average diameter of nitride particle (nm) | Increase in flow stress (kgf/mm$^2$) |
|---|---|---|---|---|---|---|---|---|
| 1 | A1 | 853 | 800 | 126 | 78 | 96 | 7 | −4.4 |
| 2 | A1 | 951 | 960 | 123 | 122 | 102 | 8 | −6.1 |
| 3 | A1 | 1055 | 910 | 118 | 21 | 51 | 3 | 3.4 |
| 4 | A1 | 835 | 1030 | 134 | 19 | 44 | 4 | 2.9 |
| 5 | A1 | 965 | 970 | 6 | 252 | 111 | 8 | −4.0 |
| 6 | A1 | 865 | 910 | 605 | 22 | 26 | 8 | 4.2 |
| 7 | A2 | 940 | 880 | 480 | 59 | 80 | 9 | −5.3 |
| 8 | A3 | 944 | 886 | 298 | 69 | 70 | 9 | −4.2 |
| 9 | A4 | 910 | 862 | 290 | 51 | 65 | 23 | −2.0 |
| 10 | A5 | 891 | 918 | 303 | 61 | 72 | 9 | −4.3 |
| 11 | A6 | 860 | 905 | 288 | 52 | 60 | 8 | −4.2 |
| 12 | A7 | 855 | 901 | 285 | 61 | 73 | 8 | −3.0 |
| 13 | A8 | 850 | 893 | 294 | 49 | 68 | 8 | −3.6 |
| 14 | A9 | 922 | 860 | 269 | 76 | 81 | 11 | −6.7 |
| 15 | A10 | 875 | 872 | 264 | 36 | 58 | 8 | −7.2 |
| 16 | A11 | 852 | 867 | 306 | 66 | 76 | 7 | −2.0 |
| 17 | A12 | 882 | 883 | 304 | 60 | 70 | 7 | −3.5 |
| 18 | A13 | 900 | 930 | 302 | 72 | 75 | 6 | −3.3 |
| 19 | A14 | 910 | 945 | 300 | 48 | 63 | 6 | −3.8 |
| 20 | A15 | 876 | 886 | 276 | 64 | 66 | 7 | −4.1 |
| 21 | A16 | 888 | 904 | 267 | 42 | 78 | 7 | −4.3 |
| 22 | A17 | 870 | 880 | 264 | 47 | 82 | 7 | −4.3 |

It is noted from Table 2 that Nos. 1, 2, 5, and 7 to 22, in which as many nitride and carbide particles as prescribed were formed in the ferrite structure according to the present invention, kept low the increase in flow stress due to dynamic strain aging. Incidentally, it was confirmed from FIG. 5 that the nitride which had precipitated in the ferrite structure was composed of AlN.

By contrast, Nos. 3, 4, and 6, which do not meet the requirements of the present invention, did not form nitrides and carbides as prescribed. They increased in flow stress.

The present invention as mentioned above efficiently provides a steel wire rod or bar which exhibits good cold deformability even though it does not undergo spheroidizing annealing after hot rolling. The present invention is of great use in that the steel wire rod or bar has a low flow stress at the temperatures (about 100–350° C.) raised by heat generation at the time of cold deforming.

Having now fully described the invention, it will be apparent to one of ordinary skill in the art that many changes and modifications can be made thereto without departing from the spirit or scope of the invention as set forth herein.

This application is based on Japanese Patent Application No. Hei 10-111130, filed Apr. 21, 1998, the entire contents of which are hereby incorporated by reference.

What is claimed is:

1. A steel wire rod or bar, comprising:

a ferrite structure, wherein the ferrite structure comprises nitride particles carbide particles nitride-nucleated carbide particles, or mixtures thereof, and wherein the particles are present in an amount of no less than 25 particles per 25 $\mu m^2$ on average in a sectional area corresponding to a concentric circle having a radius three-fourths the radius of the rod or bar, and said steel wire rod or bar has a flow stress at 320° C. which is less than the flow stress at 25° C.

2. The steel wire rod or bar as claimed in claim 1 which comprises:

C: 0.001–0.5 mass %,

Al: no more than 0.1 mass % (excluding 0 mass %), and

N: no more than 0.015 mass % (excluding 0 mass %).

3. The steel wire rod or bar as claimed in claim 1 which comprises at least one selected from the group consisting of:

Cr: no more than 1.2% mass % (excluding 0 mass %),

Ti: no more than 0.2% mass % (excluding 0 mass %),

B: no more than 0.01 mass % (excluding 0 mass %),

Nb: no more than 0.15 mass % (excluding 0 mass %),

V: no more than 0.2 mass % (excluding 0 mass %), and

Zr: no more than 0.1 mass % (excluding 0 mass %), and mixtures thereof.

4. The steel wire rod or bar as claimed in claim 1 which further comprises:

Mn: 0.035–2 mass %,

Si: no more than 0.5 mass % (excluding 0 mass %), and

S: no more than 0.02 mass % (excluding 0 mass %).

5. A machine part made from the steel wire rod or bar as claimed in claim 1.

6. A steel wire rod or bar, comprising:

a ferrite structure;

wherein the ferrite structure comprises nitride-nucleated carbide particles, and wherein the particles are present in an amount of no less than 25 particles per 25 $\mu m^2$ on average in a sectional area corresponding to a concentric circle having a radius three-fourths the radius of the rod or bar, and said steel wire rod or bar has a flow stress at 320° C. which is less than the flow stress at 25° C.

7. The steel wire rod or bar as claimed in claim 6 which comprises:

C: 0.001–0.5 mass %,

Al: no more than 0.1 mass % (excluding 0 mass %), and

N: no more than 0.015 mass % (excluding 0 mass %).

8. The steel wire rod or bar as claimed in claim 6 which comprises at least one selected from the group consisting of:

Cr: no more than 1.2% mass % (excluding 0 mass %),

Ti: no more than 0.2% mass % (excluding 0 mass %),

B: no more than 0.01 mass % (excluding 0 mass %),

Nb: no more than 0.15 mass % (excluding 0 mass %),

V: no more than 0.2 mass % (excluding 0 mass %), and

Zr: no more than 0.1 mass % (excluding 0 mass %), and mixtures thereof.

9. The steel wire rod or bar as claimed in claim 6 which further comprises:

Mn: 0.035–2 mass %,

Si: no more than 0.5 mass % (excluding 0 mass %), and

S: no more than 0.02 mass % (excluding 0 mass %).

10. A machine part made from the steel wire rod or bar as claimed in claim 6.

11. A process for preparing a steel wire rod or bar as claimed in claim 1, comprising: heating a billet at 850–1050° C., rolling it at 725–1000° C. until a diameter is reached, cooling said rolled billet with running water at a cooling rate of 600–6000° C./min down to 725–950° C., and continuing cooling at a cooling rate of 3–600° C./min down to 400° C.

12. The process as claimed in claim 11, wherein the billet is heated at a temperature of 870–1025° C.

13. The process as claimed in claim 11, wherein the heated billet is rolled at a temperature of 750–1000° C.

14. The process as claimed in claim 11, wherein the diameter of the wire rod or bar is 0.5–100 mm.

15. The process as claimed in claim 11, wherein the diameter of the wire rod or bar is 1–25 mm.

16. A steel wire rod or bar, made by a process comprising:

heating a billet at 850–1050° C., rolling said heated billet at 725–1000° C., cooling said rolled heated billet with water at a cooling rate of 600–6000° C./min down to 725–950° C., and continuing cooling at a cooling rate of 3–600° C./min down to 400° C., wherein said steel wire rod or bar has a flow stress at 320° C. which is less than the flow stress at 25° C.

* * * * *